United States Patent [19]

Neef

[11] Patent Number: 4,475,419

[45] Date of Patent: Oct. 9, 1984

[54] COUNTERHOLDING TOOL FOR ABSORBING TORQUE WHILE TIGHTENING SCREWS

[76] Inventor: Hans-Peter Neef, Schwabstrasse 33, D-7143 Vaihingen/Enz, Fed. Rep. of Germany

[21] Appl. No.: 371,834

[22] Filed: Apr. 26, 1982

[30] Foreign Application Priority Data

Apr. 30, 1981 [DE] Fed. Rep. of Germany ... 8112770[U]

[51] Int. Cl.[3] ..... B25B 9/00

[52] U.S. Cl. ..... 81/13

[58] Field of Search ..... 81/3 R, 13, 55, 56, 81/57.16, 57.34, 57.36, 177 G, 462

[56] References Cited

U.S. PATENT DOCUMENTS

| | | | |
|---|---|---|---|
| 744,930 | 11/1903 | McDaniel | 81/13 |
| 1,334,352 | 3/1920 | Dehn | 81/13 |
| 1,914,827 | 6/1933 | Hammerich | 81/13 |
| 2,832,246 | 4/1958 | Livermont | 81/177 G X |

*Primary Examiner*—James G. Smith

*Attorney, Agent, or Firm*—Edwin E. Greigg

[57] ABSTRACT

A counterholding tool for absorbing torque while tightening screws or the like, which has an element for engaging the screw nut and a stop. The element and the stop are movable relative to one another, and a releasable locking mechanism is provided by means of which the position of the two components relative to one another can be fixed. (FIG. 4).

18 Claims, 14 Drawing Figures

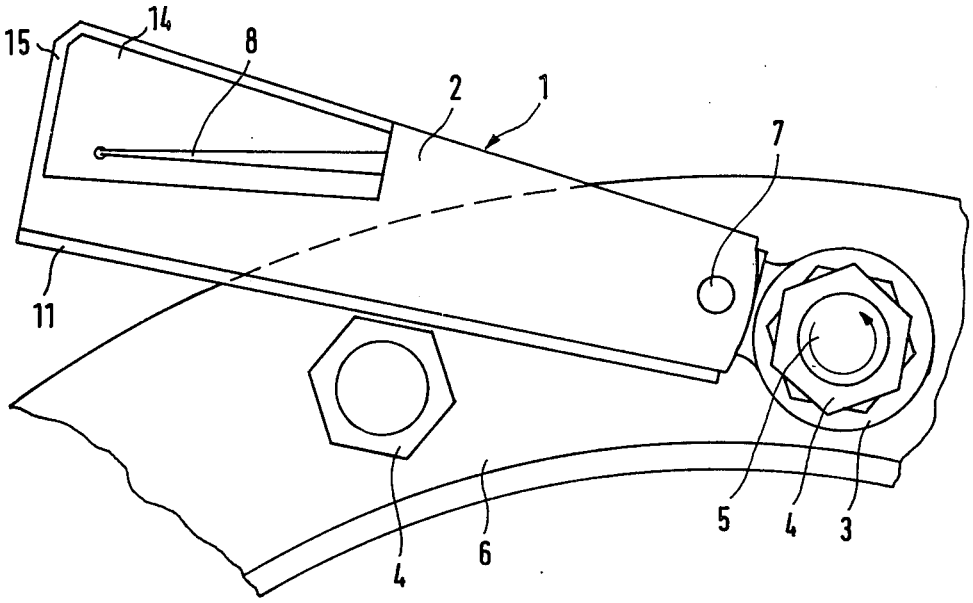
FIG. 1
FIG. 2
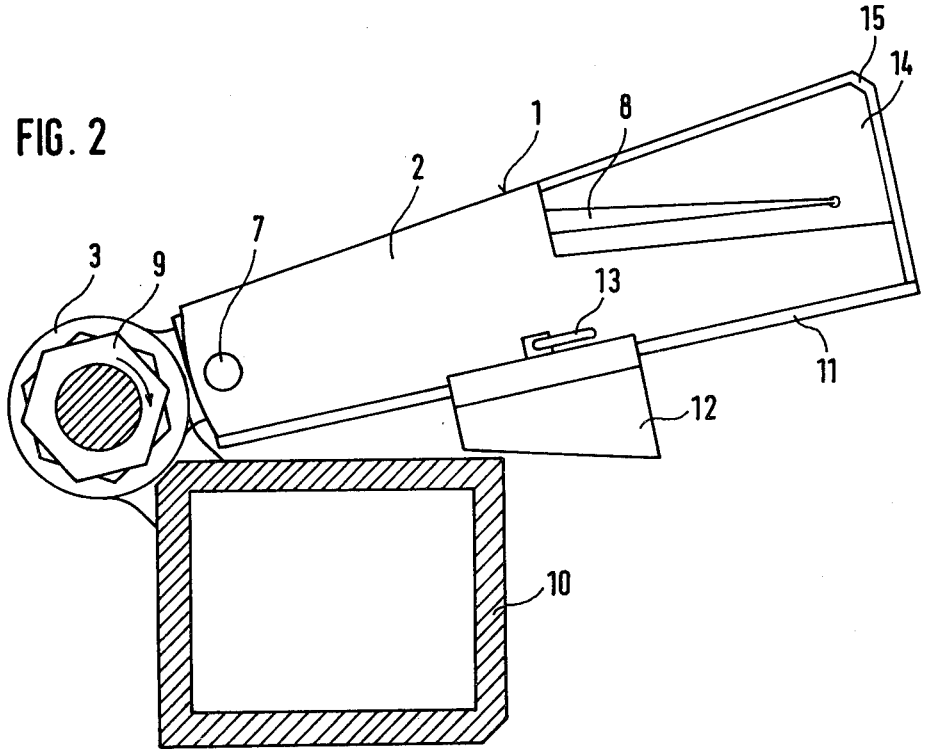

FIG. 5
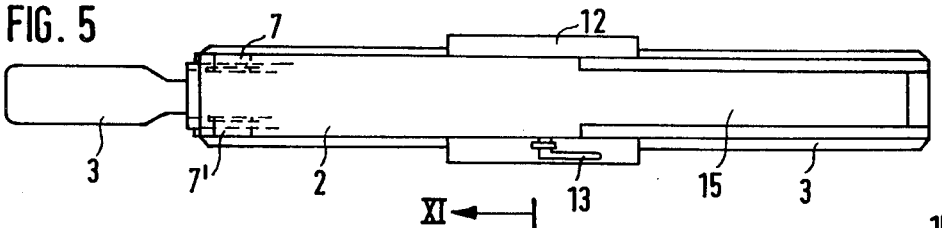
FIG. 4
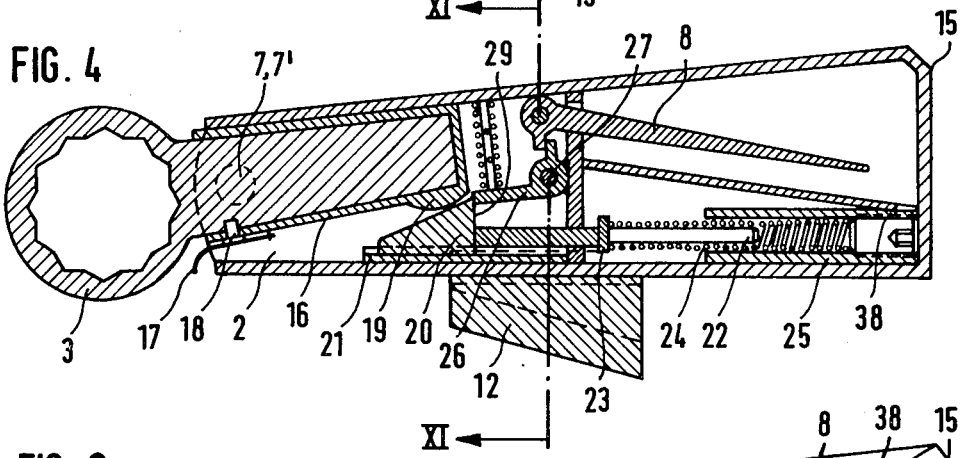
FIG. 3
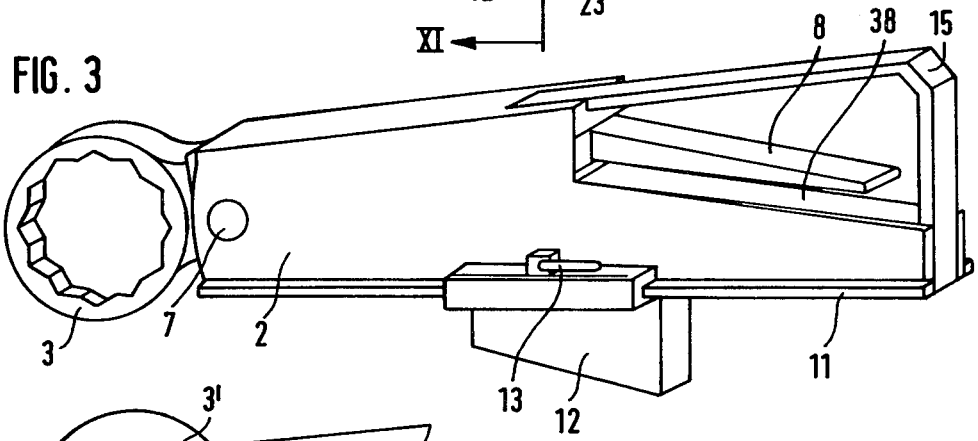
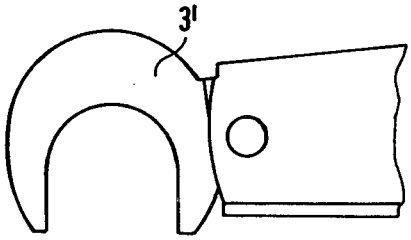
FIG. 6
FIG. 8
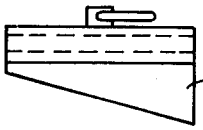
FIG. 9
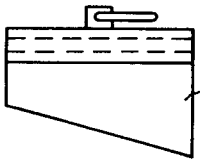
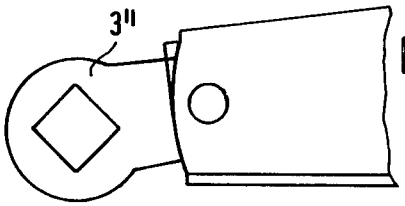
FIG. 7
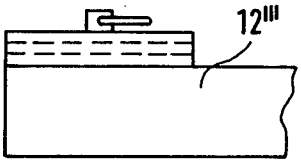
FIG. 10

COUNTERHOLDING TOOL FOR ABSORBING TORQUE WHILE TIGHTENING SCREWS

BACKGROUND OF THE INVENTION

The invention relates to a counterholding tool for absorbing torque while tightening screws or the like, which includes both an element for grasping the screw nut and a stop.

Such a counterholding tool is required if a screw is to be tightened with high torque. The screw nut is tightly held with the counterholding tool, so that it does not rotate along with the screw.

The counterholding tool generally used is a simple box-end wrench or a monkey wrench. However, if the screw is to be tightened so much that the counterholding tool can no longer be held fast by the muscular strength of a person using it, then the box-end wrench engaging the screw nut must be made to rest in a stationary manner against some arbitrary point. The face of the box-end wrench resting against that point is the "stop" in the sense referred to above.

If the screw is tightened with high torque, for example to 3000 ft-lbs with a crane connection, then the box-end wrench presses so hard against its stationary abutment that it can no longer be removed manually. The pressure exerted by the counterholding tool against its abutment varies depending on the torque applied during the tightening of the screw, the friction existing between the screw nut and that which is located beneath it, and so forth. In any case, when the torque is high applied, the box-end wrench is elastically clamped, with very great forces, between the screw nut on which it is seated and the abutment against which it rests. In order to release it from this clamped condition, a known procedure is to hammer on the wrench with a heavy hammer and thereby to force it out of frictional engagement with the abutment and the screw nut.

The disadvantage here is that the box-end wrench then moves abruptly out of its firmly clamped position, and the direction of its movement is uncontrolled. There is accordingly a great danger that an accident may occur, injuring the workers involved. Objects in the vicinity may also suffer damage as a result.

OBJECT AND SUMMARY OF THE INVENTION

It is, therefore, the object of the invention to provide a counterholding tool of the general type discussed above but which makes it possible to loosen the hold resulting from the tightening of the screw in a simple manner and without any danger of an accident.

In accordance with the invention, this object is attained in that the screw nut grasping element and the stop are movable toward one another and that a releasable locking mechanism is provided by means of which the position of the two components relative to one another can be fixed.

The tightening of the screw is effected in the locked position. The lock is then released or unlocked. The stop and the element engaging the screw nut are now pivotable toward one another, with free play relative to one another. The clamping then loosens quite easily, so that the counterholding tool can be removed from the screw nut without difficulty.

Advantageous further embodiments of the invention define preferred possibilities for embodying the locking mechanism and providing support on the given abutment.

The invention will be better understood and further objects and advantages thereof will become more apparent from the ensuing detailed description of two preferred embodiments taken in conjunction with the drawings.

BRIEF DESCRIPTION OF THE DRAWINGS

FIG. 1 shows a first exemplary embodiment of the invention;

FIG. 2 shows the first exemplary embodiment with an added attachment;

FIG. 3 shows the exemplary embodiment according to FIG. 2 in a perspective view;

FIG. 4 is a section taken through the exemplary embodiment according to FIG. 2;

FIG. 5 is a plan view of the exemplary embodiment shown in FIGS. 2–4;

FIGS. 6 and 7 shows two further inserts, intended for use with the exemplary embodiments of FIG. 1 and FIGS. 2–4, in the form of a fork wrench and a square-box wrench, respectively, for power-tightened nuts;

FIGS. 8–10 show three further support elements usable with the exemplary embodiments of FIG. 1 and FIGS. 2–4;

DESCRIPTION OF THE PREFERRED EMBODIMENTS

Figure 11:
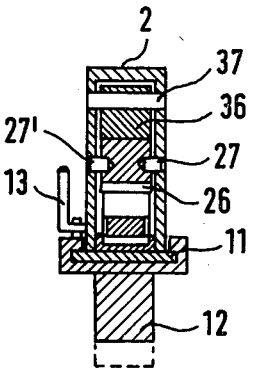
FIG. 11 is a section taken along the line XI-XI of FIG. 4.

FIG. 1 shows a counterholding tool 1, which has a housing 2 and a box-end wrench insert 3, which is placed over a screw nut 4. If the screw 5 is now tightened by suitable means (not shown) from the other side of the illustrated flange 6, and if the screw nut 4 then also rotates in the direction of the arrow under the influence of the coupling forces exerted upon it by friction, then this torque must be absorbed by the counterholding tool 1. In the type of use illustrated in FIG. 1, which shows the screw-fastening of a flange 6, this torque is absorbed by having the housing 2 rest against a further nut 4'. The housing 2 thus forms the stop of the counterholding tool 1 and the nut 4' acts as the stationary abutment. The torque exerted upon the nut 4 as the screw is tightened is thus absorbed, and the holder 2 is is pressed against the nut 4'. When the tightening of the screw 5 is finished, the counterholding tool 1 then has to be removable from the screw nut 4. This is possible only if the pressure exerted by the housing 2 against the nut 4', resulting from the tightening of the screw 5, can be made to disappear in some manner or other. This is accomplished by having the box-end wrench insert 3 pivotable in the housing 2 with the aid of bolts 7, 7' (FIGS. 1 and 4), and also by providing a locking mechanism in the housing 2. If the housing 2 and the box-end wrench insert 3 are fixed relative to one another (that is, locked) while the screw 5 is being tightened, then this locking action can be released again after the end of the screwing procedure, by actuating the handle 8. Rotational movement in the housing 2 relative to the box-end wrench insert 3 is thus restored. Then the pressure exerted against the nut 4' by the housing 2 is eliminated, and the entire counterholding tool 1 can be removed easily from the nut 4.

FIG. 2 shows a further possible use from the field of crane erection. The screw head 9, onto which the box-end wrench insert 3 is placed, is positioned geometrically relative to the rectangular element 10 such that it is not possible for the housing 2 to rest directly on any stationary abutment. In order nevertheless to assure reliable support, the counterholding tool 1 is provided on its underside with a slide track 11, on which a support element 12 is disposed such that it can be displaced and, with the aid of an arresting lever 13, arrested. This support element 12 may be adjusted along the slide track 11 such that at a suitable point it presses against some stationary part of the apparatus to be assembled, as shown in FIG. 2.

The handle 8, which serves to unlock the locking mechanism, is located in an opening 14 in the housing 2 formed by means of a bracket 15.

FIG. 4 shows the reception of the box-end wrench insert 3 in the housing 2 as well as the locking mechanism. The box-end wrench insert 3 is inserted in a receptacle 16, which in turn, as already noted, is received in a rotatable manner in the housing 2 with the aid of bolts 7, 7'. A leaf spring 17 is riveted to the receptacle 16 and is provided with a small pin 18, which in the illustrated position protrudes through an opening in the receptacle 16 and on into a hold in the box-end wrench insert 3, thus fixing it within the receptacle 16. If the leaf spring 17 is bent downward, then the pin 18 moves out of the hole in the box-end wrench insert 3, so that the insert 3 can be removed or exchanged for another.

The receptacle 16, rotatably supported in the housing 2 with the aid of the bolts 7, 7', has a slide cam 19 whose surface is rounded. The surface of the slide cam 19 rests on the surface of a wedge 20, which is displaceably supported in a guideway 21 in the housing 2. The wedge 20 is connected with a rod 22, which in turn carries a spring plate 23, against which a spring 24 disposed in a sheath 25 presses. The surface of the slide cam 19 and of the wedge 20 are inclined or adapted to one another such that when the support element 12 presses against an abutment, a displacement force is exerted upon the wedge 20 acting in the direction of the guideway 21.

Figure 12:
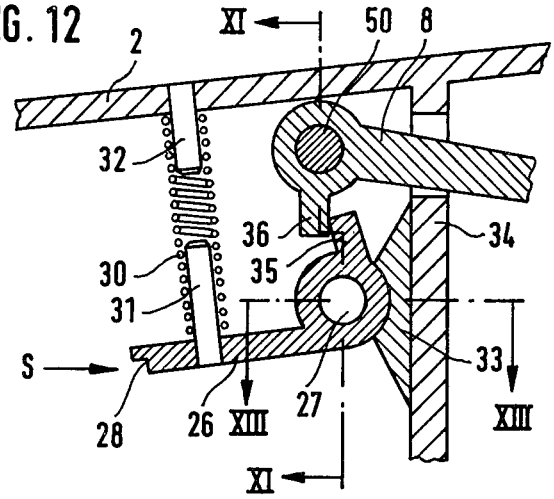
FIG. 12 is a detail of the locking mechanism of FIG. 4.
Figure 13:
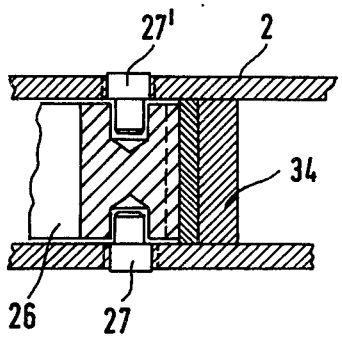
FIG. 13 is a section taken along the line XIII-XIII of FIG. 12.

The wedge 20 is held in the illustrated position by an arresting member 26 (see FIG. 12 as well). This arresting member 26 is rotatably supported in the housing 2 by a bolt 27 and presses with its notched edge 28 against the righthand shoulder 29 (extending vertically in FIG. 4) of the wedge 20. The arresting member 26 is pressed into the position shown in FIG. 4 by a spring 30, which is held in place by a bolt 31 attached to the arresting member and by a bolt 32 attached to the housing 2.

In the locking position shown in FIG. 4, the notched edge 28 of the arresting member 26 is in engagement with the shoulder 29 of the wedge 20. If torque is now exerted upon the counterholding tool in the manner shown in FIG. 2, then the slide cam 19 presses with a resultant force against the oblique face of the wedge 20; however, the wedge 20 is not capable of following the resultant displacement force in the direction of its guideway 21, because the displacement force S acts in the direction of the arrow shown in FIG. 12, toward the notched edge 28 of the arresting member 26.

As also shown in FIG. 12, the arresting member 26 is embodied with a right angle. The bearing on the bolts 27, 27' (FIG. 12) has so much play that the displacement force S in the direction of the arrow is absorbed by a bearing block 33 attached to a holder plate 34. The arresting member 26 also has a tongue 35, on which a further tongue 36 rests, which is firmly connected with the handle 8 and can be pivoted with this handle 8 about bolt 50. Now if the bracket 15 and the handle 8 are grasped (see FIG. 4), then the tongue 36 presses against the tongue 35 in such a manner that the arresting member 26 is pivoted upward, counter to the force of the spring 30. The shoulder 29 of the wedge 20 is thus released, and (in FIG. 4) the wedge 20 is abruptly pressed toward the right by the slide cam 19 on the receptacle 16 for the box-end wrench insert 3. The slide cam 19 (FIG. 4) is then capable of moving downward. However, the position of the box-end wrench insert 3 in the housing 2 is now no longer fixed; instead, the arresting action has now been released, and free play exists between the box-end wrench insert 3 and the housing 2, so that the box-end wrench insert 3 can be removed without difficulty from the nut 4 or from the screw head 9.

As shown, the spring 24 serves the purpose of damping the movement of the wedge 20 toward the right (in FIG. 4) during the unlocking process, and also serves to force the displaceable wedge 20 automatically back to the left again (FIG. 4) after the locking action has been released. The holder plate 34 is still supported relative to the rear side of the housing by the support plate 38, which at the same time defines the opening 14.

FIGS. 6 and 7 show two further inserts, in the form of a fork wrench insert 3' or square-box wrench insert 3'' for power-tightened nuts intended for further uses; FIGS. 8–10 show three further support elements 12', 12'', 12''', again for further uses.

Figure 14:
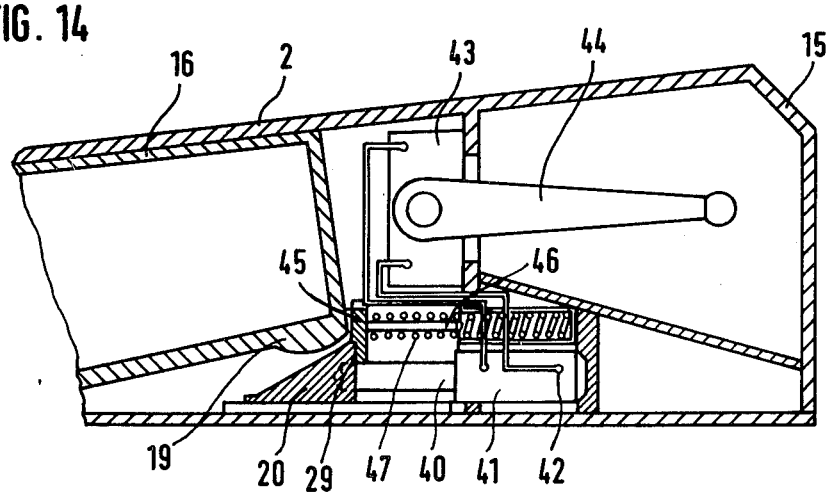
FIG. 14 is a section taken through a second exemplary embodiment.

FIG. 14 shows a second exemplary embodiment, having a hydraulic locking mechanism. The wedge 20 is connected with the piston rod 40 of a hydraulic cylinder 41. A closed-loop hydraulic line 42 leads from one end of the cylinder 41 to the valve 43 and from there back again to the other end of the cylinder 41. The valve 43 can be opened by means of a handle 44; a thrust plate 45 presses against the shoulder 29 of the wedge 20 and is connected with a guide rod 46, which is pressed to the left by a spring 47.

In the position shown in FIG. 14, with the valve 43 closed, the hydraulic fluid keeps the piston rod and thus the wedge 20 in the illustrated position. If the valve 43 is opened by the actuation of the handle 44, then hydraulic fluid flows through the line 42 from the right-hand end of the cylinder 41 into the left-hand end thereof. The piston rod 40 and with it the wedge 20 thus move toward the right. The locking mechanism is thus unlocked, and the housing 2 has free play again above the receptacle 16 or the box-end wrench insert 3. The spring 47 subsequently forces the thrust plate 45 to the left, and the thrust plate 45 in turn forces the wedge 20 to the left, back into the illustrated position. The valve 43 is then closed once again, and the counterholding tool is again ready for use.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A counterholding tool for engaging a nut, which in turn is threadedly engaged with a screw or the like, for absorbing torque while the screw or the like is tightened, comprising:

an elongated housing, nut engaging means pivotably supported in one end of said housing for engaging the threaded nut;

wedge means within said housing movable relative to the nut engaging means for securing said nut engaging means in a fixed position;

a receptable pivotably mounted within the housing, wherein the nut engaging means is partly received within the receptacle for support therein;

said wedge means is displaceably mounted within the housing and fixably positioned therein by means of said releasable locking means, wherein said receptacle is provided with a pressure face which presses against said wedge means, and releasable locking means in said housing, by means of which the wedge means may be locked and released so that the position of the nut engaging means relative to the housing may be relaxed.

2. A counterholding tool as defined in claim 1 further comprising:

a slide track on said housing, and a stop means mounted on said slide track.

3. The counterholding tool as defined in claim 1, wherein the nut engaging means comprises a box-end wrench insert.

4. The counterholding tool as defined in claim 1, wherein the nut engaging means comprises a fork wrench insert.

5. The counterholding tool as defined in claim 1, wherein the nut engaging means comprises a square box insert.

6. The counterholding tool as defined in claim 1, wherein the releasable locking means includes a hydraulic cylinder within which a piston is displaceably mounted, and wherein the wedge is connected to the piston for displacement therewith.

7. The counterholding tool as defined in claim 6, wherein the releasable locking means further includes a valve and a hydraulic line connected to the valve and to both ends of the hydraulic cylinder, and wherein the displacement of the piston is controlled by controlling the position of the valve.

8. The counterholding tool as defined in claim 7, wherein the releasable locking means further includes a thrust plate, which engages the wedge, and a spring which biases the thrust plate end thereby the wedge into the locking position.

9. The counterholding tool as defined in claim 8, wherein the wedge is automatically urged back into a new locking position by the spring when the releasable locking means is released.

10. The counterholding tool as defined in claim 1, further comprising:

a guideway for guiding the wedge during displacement thereof.

11. The counterholding tool as defined in claim 1, further comprising:

spring means for damping the displacement of the wedge.

12. The counterholding tool as defined in claim 11, wherein the wedge is automatically urged back into a new locking position by the spring means when the releasable locking means is released.

13. The counterholding tool as defined in claim 1, further comprising:

a hydraulic cylinder for damping the displacement of the wedge.

14. The counterholding tool as defined in claim 1, wherein the releasable locking means includes an arresting member and a handle, said arresting member engaging said wedge, and wherein said arresting member is movable by said handle.

15. The counterholding tool as defined in claim 14, wherein said wedge includes a shoulder and said arresting member includes a notched edge, said releasable locking means further includes a spring which biases the arresting member in a direction so that the notched edge presses against the wedge shoulder.

16. The counterholding tool as defined in claim 14, wherein the releasable locking means further includes a holder plate and a bearing block mounted to the holder plate, and wherein the arresting member comprises an L-shaped element rotatably mounted in the housing and supported against the holder plate by the bearing block.

17. The counterholding tool as defined in claim 1, which includes a stop means comprising a support element mounted on said elongated housing.

18. The counterholding tool as defined in claim 17, further comprising:

a slide track on the housing on which the support element is displaceable; and an arresting lever for fixing the position of the support element on the slide track.

* * * * *